United States Patent [19]

Costakis

[11] 4,119,515

[45] Oct. 10, 1978

[54] APPARATUS FOR ELECTROPLATING SHEET METALS

[75] Inventor: Andrew L. Costakis, Portage, Ind.

[73] Assignee: National Steel Corporation

[21] Appl. No.: 782,016

[22] Filed: Mar. 28, 1977

[51] Int. Cl.[2] ..... C25D 17/12; C25D 17/02

[52] U.S. Cl. ..... 204/211; 204/28; 204/DIG. 7

[58] Field of Search ..... 204/28, 206–211, 204/DIG. 7

[56] References Cited

U.S. PATENT DOCUMENTS

| | | | |
|---|---|---|---|
| 1,700,173 | 1/1929 | Porzel | 204/279 |
| 2,461,556 | 2/1949 | Lorig | 204/28 |
| 2,610,145 | 9/1952 | Kompart | 204/206 |
| 3,445,371 | 5/1969 | Johnston | 204/206 |
| 3,880,725 | 4/1975 | Van Raalte et al. | 204/15 |
| 3,900,383 | 9/1975 | Austin et al. | 204/211 |

FOREIGN PATENT DOCUMENTS

| | | | |
|---|---|---|---|
| 1,380,724 | 10/1964 | France | 204/DIG. 7 |

*Primary Examiner*—F.C. Edmundson

*Attorney, Agent, or Firm*—Shanley, O'Neil & Baker

[57] ABSTRACT

Metal in sheet or strip form is electroplated in a continuous or semi-continuous process in which a running length of the metal is passed through a bath of electrolyte solution having an anode structure supported therein adjacent the surface or surfaces to be electroplated. The structure of the anode enables use of the apparatus to electroplate strips of various widths without encountering adverse side effects or streaking and enables substantial economies in electrical current. The anode structure is particularly useful in the production of strip steel having a zinc coating on one side only.

37 Claims, 7 Drawing Figures

FIG. 4
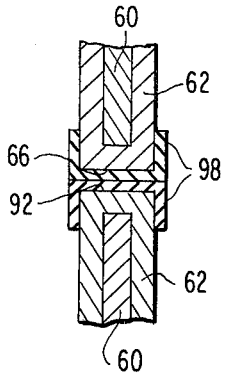
FIG. 3
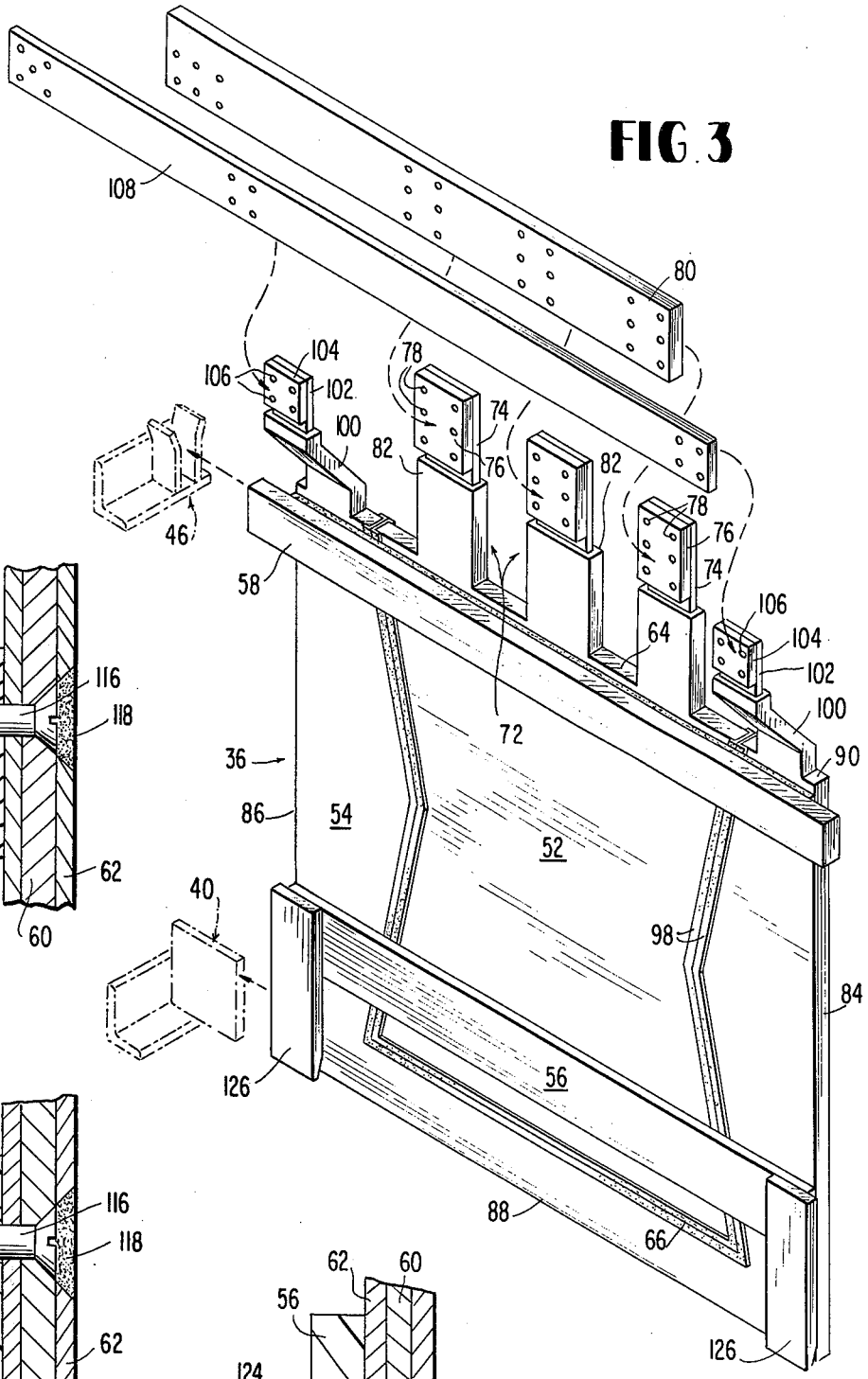
FIG. 5
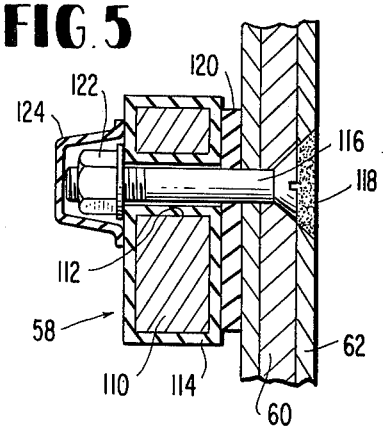
FIG. 6
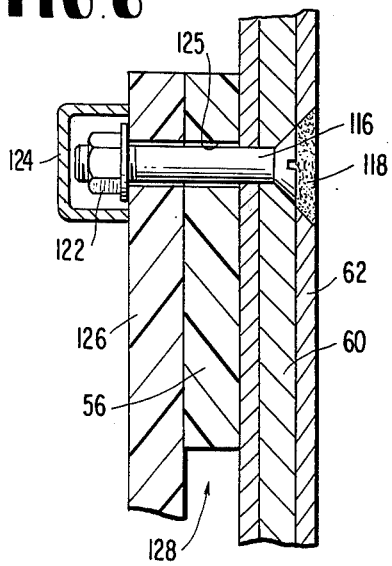
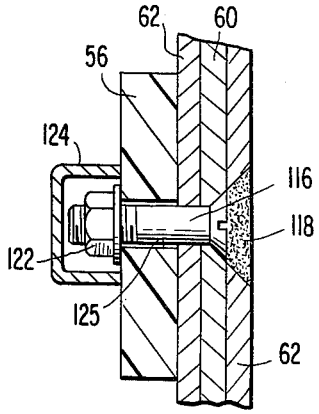
FIG. 7

APPARATUS FOR ELECTROPLATING SHEET METALS

BACKGROUND OF THE INVENTION

1. Field of the Invention

This invention relates to an anode for use in the production of electroplated metal and more particularly an improved anode for use in the continuous electroplating of elongated flat sheet and strip metal such as flat rolled steel, hereinafter sometimes referred to generally as strip. The anode of the invention is especially useful in the production of galvanized strip steel having a zinc coating on one side only.

2. Description of the Prior Art

The electroplating of strip metal is a well-known and widely used process, particularly for the plating of a corrosion-resistant coating on a base metal strip such as rolled steel. Such product is produced by passing a running length of the base strip through a bath of an electrolyte solution with the flat surface or surfaces which are to be coated passing in close parallel relation to a generally flat anode submersed in the solution. The anodes are conventionally of a generally rectangular shape and preferably have a width approximately equal to the width of the strip being plated. However, apparatus used in such plating operations is frequently employed to produce strip of different widths depending upon the intended use of the coated strip. Thus, an electroplating line designed to plate strip having a maximum width of, for example, 72 inches may be employed to process strip of substantially less than this maximum width.

The use of an anode having a width substantially greater than the width of the strip being electroplated is undesirable for several reasons. For example, the electrical energy necessary to maintain the required current density for effective electroplating will vary with the size of the anode so that energy is wasted when an anode is used which is wider than necessary. Further, the tendency to plate a heavier coating at the edges of the strip is aggrevated by an excessively wide anode, resulting in an undesirable uneveness in plating across the width of the strip.

Another problem encountered in plating strip is the greater propensity for more narrow strips to wander off the center of the desired pass line as it moves through the apparatus. This poor tracking can again result in an uneven coating across the width of the strip, particularly if it wanders to the extent that one edge projects outwardly beyond the edge of the anode.

A further problem is encountered when employing a conventional rectangular anode which is substantially wider than the base strip used in the production of one-side galvanized strip by the process disclosed in U.S. Pat. Nos. 3,988,216 and 3,989,604, which patents are assigned to the assignee of the present invention. These patents disclose a process in which a strip, previously galvanized on both sides, is passed through a bath of electrolyte solution between an anode and a separate cathode so as to remove the zinc coating from one side of the strip while simultaneously electrodepositing a substantially equivalent amount of zinc on the opposite side. In producing one-side galvanized strip according to the method of those patents, there is a tendency for zinc to re-plate around the edges of the strip onto the side thereof from which the zinc has been removed when the high current densities required for high speed production is used in an apparatus having an anode substantially wider than the strip being coated.

It would, of course, be possible to change the anode in a strip-plating apparatus each time that a strip of a different width is processed. However, this is not a practical solution in a high-speed production line because the time required to affect the change-over would be prohibitive. Further, the anodes are normally connected to a source of electrical current by bus-bars which are designed to supply current across the width of the anode so that it would normally be necessary to change or modify the bus-bars when changing from one size anode to another. Also, the anodes are heavy and difficult to handle, and are easily damaged.

SUMMARY OF THE INVENTION

In accordance with the present invention, the foregoing and other defects of the prior art are overcome by employing an anode structure made up of a plurality of segments which are electrically isolated from one another and supplied with electrical current by a bus-bar arrangement which permits energization of the individual segments selectively. In accordance with one embodiment of the invention, the anode consists of a central segment in the form of a flat lead plate having parallel top and bottom edges and side edges in the form of inwardly-directed shallow V's so that the transverse dimension at the central portion of the segment is slightly less than at the parallel top and bottom edges. A second generally flat lead plate anode segment has a generally U-shaped configuration, and is supported in co-planar relationship with the first segment, with the upwardly-directed leg portions of the second segment having inner edges which are substantially complementary to the adjacent shallow V-shaped edges of the first section. A layer of insulating material is preferably positioned between the adjacent edges of the inner and outer segments, and each are provided with separate bus-bar connecting plates so that electrical current may be supplied to the two segments independently.

It is, accordingly, the primary object of the present invention to provide an improved anode assembly for electroplating strip metal.

It is a further object of the invention to provide an improved electroplating anode having a plurality of segments electrically isolated from one another and having means for separately supplying electrical energy to the individual segments whereby all or a portion only of the anode structure may be electrically charged selectively.

BRIEF DESCRIPTION OF THE DRAWINGS

The foregoing and other objects and advantages of the invention will become more apparent from the detailed description contained hereinbelow, taken in conjunction with the drawings, in which:

FIG. 3 is an exploded isometric view of the reverse side of the anode and bus-bar shown in FIG. 2;

FIG. 4 is an enlarged fragmentary sectional view taken on line 4—4 of FIG. 2;

FIG. 5 is an enlarged fragmentary sectional view taken on line 5—5 of FIG. 2;

FIG. 6 is an enlarged fragmentary sectional view taken on line 6—6 of FIG. 2; and FIG. 7 is an enlarged fragmentary sectional view taken on line 7—7 of FIG. 2.

DESCRIPTION OF THE PREFERRED EMBODIMENTS

Figure 2:
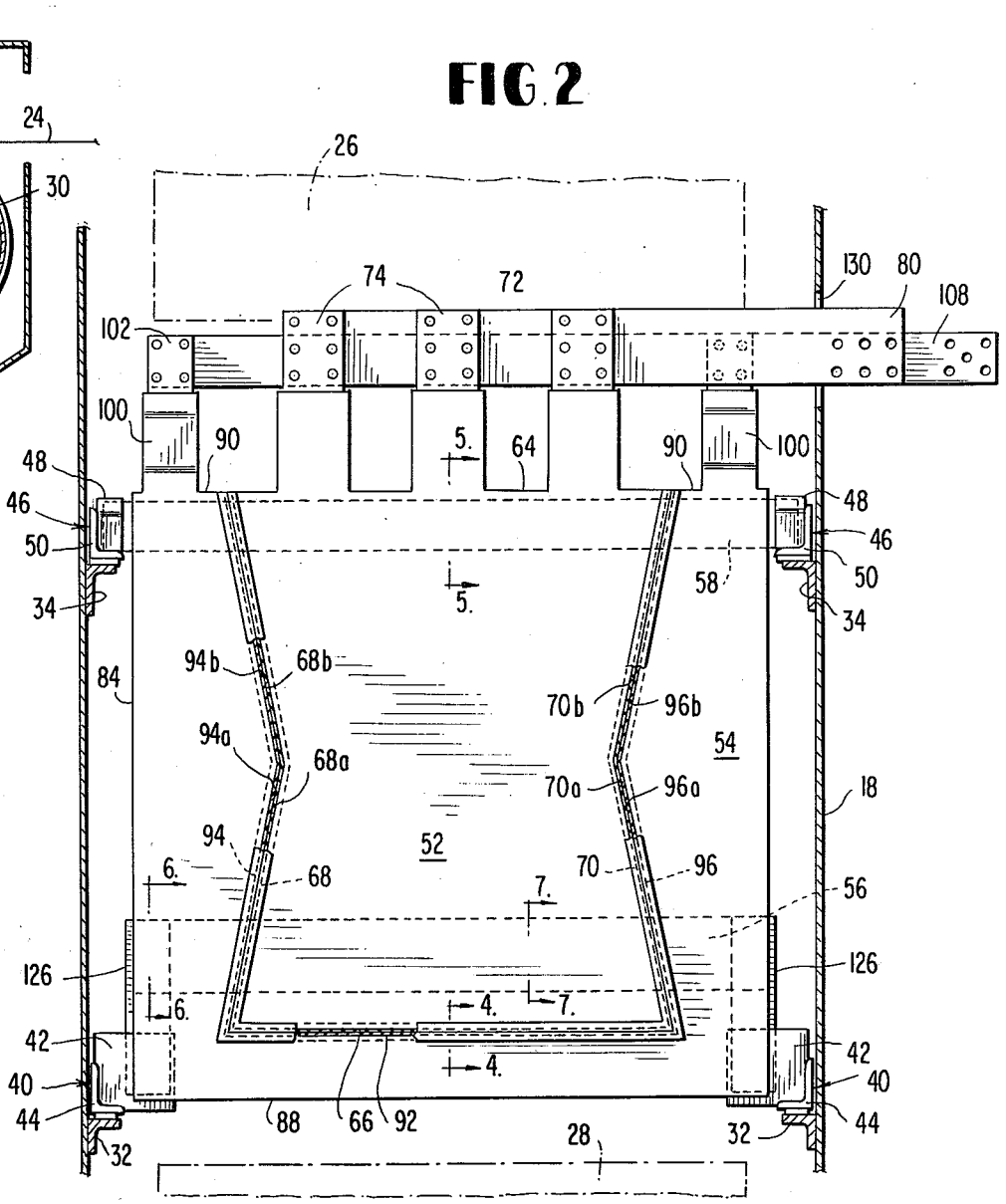
FIG. 2 is a fragmentary sectional view taken on line 2—2 of FIG. 1 and showing the anode and bus-bar structure.

Referring now to the drawings, an electroplating apparatus of the type used in coating steel strip is indicated generally by the reference numeral 10 and includes an electrolyte tank defined by end walls 12, 14, side walls 16, 18 and a bottom wall 20. A movable top cover 22 may be positioned over the top of the tank where necessary. The strip 24 to be coated passes above the top of end wall 12 and is guided in a fixed path through an electrolyte solution in the tank by three spaced, parallel guide rolls 26, 28, 30. Roll 26 is mounted adjacent the end wall 12 near the top of the tank, and roll 30 is mounted adjacent end wall 14 adjacent the top of the tank, while roll 28 is mounted adjacent the bottom wall of the tank. Rolls 26 and 30 are spaced apart a distance substantially equal to the diameter of roll 28 so that strip 24 entering the tank over the end of wall 12 passes over roll 26, then vertically down through the tank, around roll 28 and vertically up and over roll 30 to exit above wall 14.

The side walls 16 and 18 each have lower and upper structural angle members 32, 34, respectively, rigidly joined to their inner surface with one leg of each of the angles projecting inwardly from the wall to provide a supporting ledge for the anodes 36 and cathodes 38 between which the strip passes. Since the cathode assembly 38 forms no part of the present invention, it will not be described in detail herein, nor will the portion of the electrolyte tank structure employed to support or supply electrical current to the cathode be described.

A pair of anode bottom guide assemblies 40 are supported within the electrolyte tank 10 one on each of the bottom structural angles 32. The bottom guides 40 each consist of a vertically-extending rectangular plate member 42 rigidly welded to a structural angle base 44 secured to the top of the angle 32 by suitable fastener means such as bolts, not shown. The guide members 42 are mounted a predetermined fixed distance from the vertical path of the strip 24 downward through the tank 10 between roll 26 and roll 28, with the plane of the plate members 42 extending in the vertical direction parallel to the strip passing adjacent thereto. A second pair of bottom guide assemblies 42 are mounted on bottom angles 42 in fixed spaced relation to the metal strip passing from the bottom roll 28 upward to the top guide roll 30, with the second pair of bottom guides being positioned in fixed relation to the same face or surface of the strip 24 as the first set of bottom guides.

Mounted on the upper angle members 34, one above each of the bottom guides 40, are four anode support brackets 46. The respective brackets 46 consist of a pair of spaced plate members 48 rigidly mounted on an angle base 50 which, in turn, is supported on the top of angle 34 and rigidly joined thereto by suitable means such as bolts, not shown. The pairs of plates 48 project inwardly into the tank in laterally spaced relation, and are spaced slightly farther apart at their top than at the bottom to provide for guiding the anode into position on the support brackets as will be more fully described hereinbelow.

Referring now to FIGS. 3 - 7, the anode assembly 36 consists of inner and outer plate members 52, 54, respectively, rigidly joined together by a flat bar 56 which extends across the anode assembly for substantially its full width, and in upwardly spaced relation to its bottom edge and by a support beam 58 which extends transversely of and projects outwardly from the side edges of plate 54 adjacent its top edge. The inner and outer plate members 52, 54 each consist of an inner core in the form of a plate 60 preferably formed of copper or other highly conductive metal having substantial strength, and an outer coating in the form of a layer of lead 62 laminated directly onto and completely covering the outer surface of the core 60.

The inner plate member 52 has parallel top and bottom edges 64, 66, and is necked down slightly in the central portion, from the side edges 68, 70, respectively, which preferably are in the shape of shallow V's, i.e., generally straight-lined top sections **68*a*, 70*a* and bottom sections 68*b*, 70*b* of the side edges meet in the center of the plate member at a very large obtuse angle. For example, in one embodiment of the anode assembly, this central panel 52 has a total width at the top and bottom of 65½ inches and a total width at the center of 47½ inches, with the distance between the top and bottom edges 64, 66**, being 73 inches.

Three substantially identical bus-bar attaching arms 72 are integrally formed on and project upwardly from the top edge 54 of the inner anode plate member 52. The arms 72 are spaced from one another across the width of member 52 and each consist of an upwardly-extending bar 74 integrally formed with or rigidly joined to the core 60 and terminating at its top by an electrically conductive spacing block 76 having a plurality of threaded apertures 78 formed therein for direct attachment, by bolt members, not shown, to a first bus-bar 80. The portion of the bar 74 below the plate 76 has an outer coating 82 of lead integrally formed with the lead coat 62.

The outer U-shaped plate member 54 has parallel vertical side edges 84, 86 and a straight horizontal bottom edge 88 extending in parallel relation to and spaced below the bottom edge 66 of member 52. The top edge 90 of the plate member 54 forms, in effect, an extension of the top edge 64 of plate member 52 when the anode is assembled. The concave portion of member 54 is defined by a horizontal bottom edge 92 parallel to edges 66 and 88, and opposed inwardly convex upwardly extending side edges 94, 96. Side edge 94 consists of a lower straight edge section **94*a* and an upper straight edge section 94*b* and edge 96 consists of lower straight edge section 96*a* and upper straight edge section 96*b*. The convex side edges 94, 96 are substantially complementary to the concave side edges 68, 70. However, the dimensions of the inner plate member 52 are such that, when assembled, the opposing edge surfaces of members 52 and 54 are slightly spaced from one another, and this spacing is filled with a pair of generally channel-shaped electrically insulating strips 98 (see FIG. 4) fitted onto the respective opposed edge portions, with the two insulating segments 98 abutting one another and electrically isolating the plate members 52, 54** from one another.

Each upstanding side portion of anode plate member 54 has a bus-bar attaching arm 100 projecting upwardly from the top edge 90, with each arm 100 consisting of a central bar 102 integrally formed with or rigidly joined to the central core plate 60. An electrically conductive spacing block 104 is rigidly joined to the top of arm 104 and has a plurality of threaded apertures 106 formed therein for attaching the plate 54 to a second bus-bar 108. The arms 102 are offset to the back side of the anode, i.e., the side opposite to that which is adjacent the strip metal during use, to provide access for connecting the bus-bars 80 and 108 independently.

As shown in FIG. 5, the top support beam 58 consists of a metal bar 110 having an overall length somewhat greater than the width of outer plate member 54 so that, when assembled on the anode structure, the ends of the beam project outwardly from each side edge thereof. A plurality of openings 112 are formed through the bar 110, at spaced intervals therealong, and the entire surface of the metal bar, including the inner periphery of the openings 112, is covered with a rubber coating 114 to electrically insulate the bar and seal it from the corrosive electrolyte solution.

Support bars 56 and 58 are rigidly joined to the anode assembly by a plurality of screw members 116 extending through the plate members 52, 54, with the heads of the screws 116 being countersunk into the plate members and preferably silver-soldered to the copper core 60 to firmly retain the screws against turning. The heads of the screws 116 are then sealed by a lead plug 118 cast flush with the surface of the lead coat 62. A spacer 120 of rubber-like gasket material is positioned between the support beam 58 and the adjacent surface of plate members 52 and 54, and the beam is firmly clamped onto the plate members by nuts 122 threaded onto the ends of screws 116. A cap member 114 formed of a rubber or plastic material which will not be affected by the electrolyte solution covers each of the nuts 122 so that the fastening assembly is completely sealed. The rubber coating extending through the openings 112 electrically insulates the metal bar 110 from the screws 116.

The cross-plate 56 is employed to retain the plate members 52 and 54 in firmly assembled co-planar relation but is not employed to support the anode assembly in the electrolyte tank during the plating process. Accordingly, the cross-plate 56 is preferably formed from a rigid synthetic resin material which will be unaffected by the electrolyte solution and which, while being of a lower strength than the metal beam 110, will have sufficient strength to maintain the plates in their assembled, aligned relation. The plate 56 is provided, at spaced intervals along its length, with openings 125 through which clamping screws 116 pass to clamp the cross-plate into contact with the surface of the lead coat 62. Preferably, a resilient rubber-like gasket material, not shown, is provided between the plate 56 and the lead coat 62 to assure protection of the screw 116 and nuts 122 against the corrosive action of the electrolyte solution.

When it is desired or necessary to remove the anode from the tank 10, the top cover 22 is removed and the bus-bars are disconnected and removed. The anode assembly may then be lifted directly from the tank. Conversely, the anode assembly may be installed in the tank by simply lowering and guiding the unit into position with the plates 42 projecting into the slots 128. The outwardly diverging top portion of the plates 48 engage and guide the ends of the bar 58 into position to accurately align and retain the anode in position in the tank.

Figure 1:
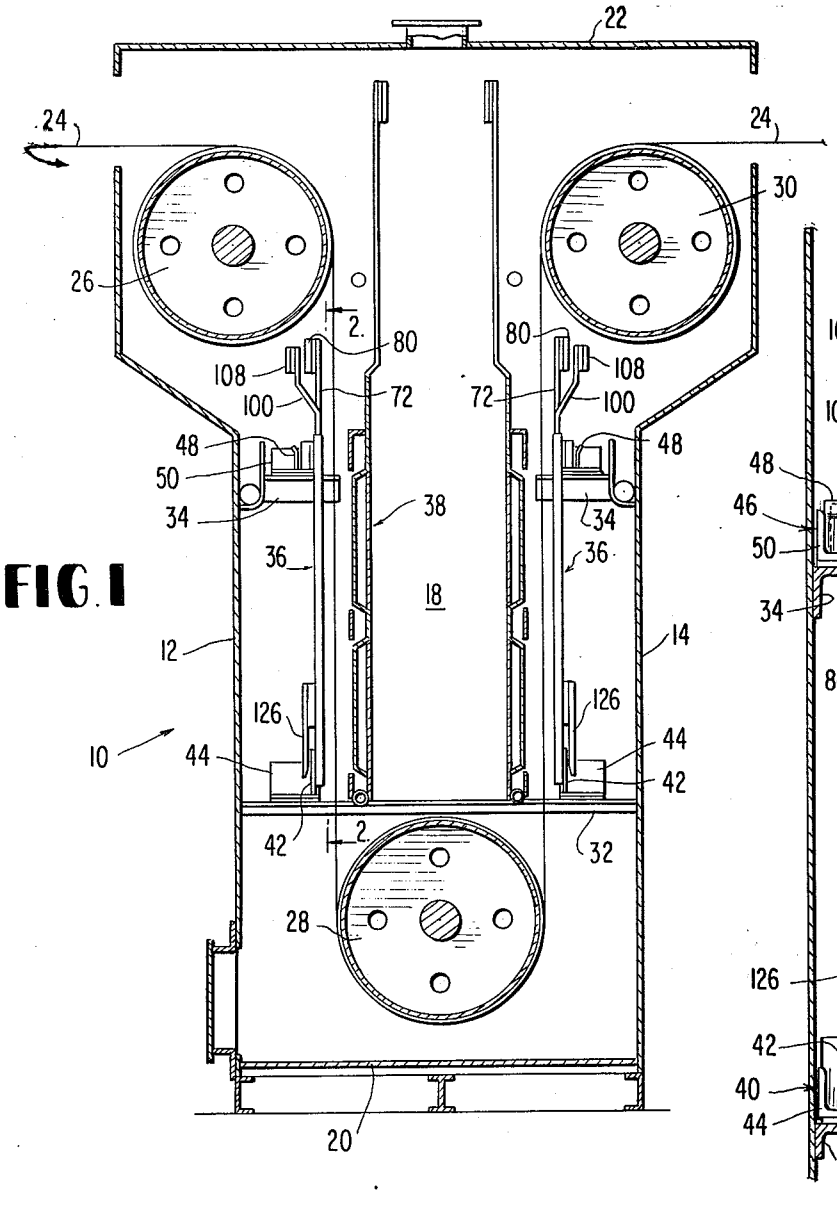
FIG. 1 is a side elevation view, in section, of an electroplating apparatus employing an anode according to the present invention used to coat strip metal.

As best seen in FIGS. 3 and 6, a pair of guide plates 126 are mounted one on each end of the bar 56 by screws 116 and nuts 122, with the ends of plate 126 projecting downwardly below the bar in spaced relation to the surface of the lead coat 62. The space 128 between the guide plates 126 and the anode plate member 54 is adapted to receive the upwardly projecting plate member 42 of the bottom guides 40 when the anode assembly is mounted in the electrolyte tank as illustrated in FIGS. 1 and 2. In this position, the outwardly projecting ends of support beam 58 rest firmly on the ledge defined by the angles 34 and top support brackets 46, between the upwardly-projecting plates 48, so that the anode assembly is firmly retained in accurately-aligned position within the tank. In this position, the bus-bars 80 and 108 which supply electrical current to the sections of the anode defined by the plate members 52 and 54, respectively, project outwardly through an opening 130 in wall 18, in laterally spaced relation to permit easy access for separate connection to the positive terminal of a D.C. energy source. The separate connections of the anode plate members thus enables electric current to be supplied to one or both of the plate sections selectively to thereby vary the effective width of the anode without requiring any changes within the electrolyte tank.

The overall configuration of the effective surface area of the anode assembly is rectangular as shown in FIG. 2, with the transverse dimension being sufficient to accommodate the widest strip material which is to be electroplated in the apparatus, and preferably occupying substantially the full transverse width of the electrolyte tank 10. By supplying electrical current to both anode sections, the current density will be substantially uniform over the entire anode surface with the exception of the area of the narrow space between the adjacent edges of the two plate assemblies, which space is occupied by the insulating strip 98. Since this insulating layer is relatively narrow, and since it does not extend in a true longitudinal direction, i.e., a direction parallel to the direction of movement of strip through the apparatus, this relatively small uncharged portion of the anode's total surface area does not have any detectable effect on the plating weight. Thus, a wide strip, i.e., a strip having a width substantially greater than the width of the center anode plate section, may be coated on the apparatus using the segmented anode without any detectable streaking or other adverse affects resulting from this narrow uncharged portion of the anode surface.

When a narrow strip is to be plated on the apparatus, it is merely necessary to discontinue the supply of electrical current to the outer, U-shaped segment of the anode to thereby conserve substantial amounts of electrical energy without requiring any modification within the electroplating tank. In addition, reducing the width of the charged portion of the anode structure to more closely conform to the width of the strip reduces the tendency to plate around the edge of a narrow strip. Further, it has been found that the hour-glass configuration of the inner segments enables a more uniform coating of strip having a width substantially equal to or slightly greater than the minimum transverse dimension of the inner anode segment even when the strip wanders slightly from the center path line through the apparatus. This effect is apparently due to the elimination of or reduction in the usual edge effect which normally results in a heavier current density and consequently heavier coating adjacent the side edges of a rectangular anode.

While the anode is segmented, the surface adjacent the strip to be coated is maintained in a continuous plane, with all of the structure employed to retain the segments in assembled relation being on the opposite or back side of the anode plate. All of this structure is effectively sealed from the corrosive effect of electrolyte solutions conventionally employed in electrolytic coating processes so that the segmentation of the anode does not affect the useful life or the manner in which the anode is utilized. Further, in the event of inadvertent damage to one segment, this segment may be replaced at considerably less cost than would be required to replace the entire anode assembly.

While a single embodiment of the invention has been described, it is believed apparent that various modifications might be made without departing from the spirit of the invention. Thus, while an anode employing only two segments has been illustrated, it is believed apparent that three or more plate segments might be employed. Further, while the plating apparatus is illustrated as employing two anodes supported in a vertical position in an electrolyte tank, it is believed apparent that any desired number of anodes might be employed and that they might be supported in various positions such as in an inclined or horizontal position, and that the structure for supporting the anode assembly might readily be modified as required. Accordingly, while I have disclosed and described a preferred embodiment of my invention, I wish it understood that I do not intend to be restricted solely thereto, but rather that I do intend to include all embodiments thereof which would be apparent to one skilled in the art and which come within the spirit and scope of my invention.

I claim:

1. In an apparatus for electroplating an elongated strip of metal as the strip is drawn longitudinally past a positively charged anode submerged in a bath of electrolite solution, an anode structure comprising, a generally flat substantially rectangular anode body defined by a plurality of flat plate body segments each having side and end edges, mounting means for supporting the body segments in a common plane in contiguous relation to one another to define a substantially continuous anode surface extending in a plane substantially parallel to the plane of the metal strip, the mounting means supporting the body segment with at least one end edge extending substantially transversely of the direction of movement of the metal strip and with at least one side edge on each body segment extending in closely spaced relation to a side edge on another body segment, the closely spaced side edges on adjacent body segments extending in the general direction of but not parallel to the direction of movement of the metal strip through the apparatus, means electrically insulating the body segments from one another, and connector means for independently connecting each body segment to a source of electrical energy whereby the respective body segments may be electrically energized selectively.

2. The invention as defined in claim 1, wherein the means electrically isolating the segments includes an elongated strip of electrically insulating material disposed between the adjacent edges of the respective segments.

3. The invention as defined in claim 2, wherein the closely spaced parallel side edges of adjacent anode body segments extend in a direction inclined at an acute angle relative to the direction of movement of strip metal when the anode structure is mounted in the apparatus.

4. The invention as defined in claim 3, wherein the anode body comprises a central body segment and at least one generally U-shaped segment.

5. The invention as defined in claim 4, wherein the generally U-shaped segments comprise a base portion having parallel end edges extending transverse to the direction of strip movement when the anode is mounted in the electroplating apparatus, and integrally formed arm portions projecting from the base section one adjacent each end thereof, the arm portions each having inwardly directed side edge portions adapted to extend in closely spaced parallel relation to outwardly directed side edge portions of an anode body segment disposed between the arm portions.

6. The invention as defined in claim 5, wherein the central body segment has parallel end edges and outwardly concave side edges each defined by a pair of substantially straight edge sections extending one from each end edge, and wherein the inwardly directed opposed edges of the adjacent upwardly extending arm portions are convex, the convex edges each being defined by a pair of substantially straight edge sections extending in closely spaced parallel relation to the straight edge sections of one of the concave side edges of the central body section.

7. The invention as defined in claim 6, wherein the connector means further comprises tab means integrally formed on and projecting outwardly from one end edge of each of the body segments and adapted to be connected to conductor means for independently connecting the respective segments to a source of electrical energy.

8. The invention as defined in claim 7, wherein the mounting means for supporting the anode structure in the electroplating apparatus comprises means for supporting the anode in a vertical direction with the electrical connection means on each body segment extending upwardly from the flat body.

9. The invention as defined in claim 8, wherein the electrical connection means on the respective anode body segments are disposed in planes generally parallel to the plane of the anode body and spaced from one another to permit each anode segment to be electrically connected to a separate bus-bar extending transversely of the anode plate.

10. The invention as defined in claim 9, wherein the anode assembly consists of two anode body segments only, including a central anode body segment and an outer segment surrounding the central body segment on at least three edges, the outer segment having parallel outer edges extending substantially perpendicular to the end edges of the respective segments.

11. The anode as defined in claim 10, wherein the anode body segments each comprise an inner core of a first electrically conductive metal and an outer coating of lead laminated directly onto and covering the core.

12. The invention as defined in claim 11, wherein the core comprises a flat plate of copper.

13. The invention as defined in claim 1, wherein the closely spaced side edges extend from an end edge on the respective segments, and wherein the closely spaced parallel side edges of adjacent anode body segments extend in a direction inclined at an acute angle relative to the direction of movement of strip metal when the anode structure is mounted in the apparatus.

14. The invention as defined in claim 13, wherein the anode body comprises a central body segment and at least one generally U-shaped segment, the generally U-shaped segments comprising a base portion having parallel end edges extending transverse to the direction of strip movement when the anode is mounted in the electroplating apparatus, and integrally formed arm portions projecting from the base section one adjacent each end thereof, the arm portions each having inwardly directed side edge portions adapted to extend in closely spaced parallel relation to outwardly directed side edge portions of an anode body segment disposed between the arm portions.

15. The invention as defined in claim 14, wherein the central body segment has parallel end edges and outwardly concave side edges each defined by a pair of substantially straight edge sections extending one from each end edge, and wherein the inwardly directed opposed edges of the adjacent upwardly extending arm portions are convex, the convex edges each being defined by a pair of substantially straight edge sections extending in closely spaced parallel relation to the straight edge sections of one of the concave side edges of the central body segment.

16. The invention as defined in claim 15, wherein the connector means further comprises tab means integrally formed on and projecting outwardly from one end edge of each of the body segments and adapted to be connected to conductor means for independently connecting the respective segments to a source of electrical energy.

17. The invention as defined in claim 16, wherein the mounting means for supporting the anode structure in the electroplating apparatus comprises means for supporting the anode in a vertical direction with the electrical connection means extending upwardly from the flat body, and wherein the electrical connection means on the respective anode body segments are disposed in planes generally parallel to the plane of the anode body and spaced from one another to permit each anode segment to be electrically connected to a separate bus-bar extending transversely of the anode plate.

18. The invention as defined in claim 17, wherein the anode body segments each comprise an inner core of a first electrically conductive metal and an outer coating of lead laminated directly onto and covering the core.

19. The invention as defined in claim 13, wherein the anode body comprises a central body segment and at least one generally U-shaped segment.

20. The invention as defined in claim 19, wherein the generally U-shaped segments comprise a base portion having parallel end edges extending transverse to the direction of strip movement when the anode is mounted in the electroplating apparatus, and integrally formed arm portions projecting from the base section one adjacent each end thereof, the arm portions each having inwardly directed side edge portions adapted to extend in closely spaced parallel relation to outwardly directed side edge portions of an anode body segment disposed between the arm portions.

21. The invention as defined in claim 20, wherein the central body segment has parallel end edges and outwardly concave side edges each defined by a pair of substantially straight edge sections extending one from each end edge, and wherein the inwardly directed opposed edges of the adjacent upwardly extending arm portions are convex, the convex edges each being defined by a pair of substantially straight edge sections extending in closely spaced parallel relation to the straight edge sections of one of the concave side edges of the central body segment.

22. The invention as defined in claim 13, wherein the connector means further comprises tab means integrally formed on and projecting outwardly from one end edge of each of the body segments and adapted to be connected to conductor means for independently connecting the respective segments to a source of electrical energy.

23. The invention as defined in claim 22, wherein the mounting means for supporting the anode structure in the electroplating apparatus comprises means for supporting the anode in a vertical direction with the electrical connection means extending upwardly from the flat body, and wherein the electrical connection means on the respective anode body segments are disposed in planes generally parallel to the plane of the anode body and spaced from one another to permit each anode segment to be electrically connected to a separate bus-bar extending transversely of the anode plate.

24. The invention as defined in claim 23, wherein the anode assembly consists of two anode body segments only, including a central anode body segment and one generally U-shaped anode segment, the U-shaped segment having parallel outer side edges extending substantially perpendicular to the end edges of the respective segments.

25. The invention as defined in claim 24, wherein the anode body segments each comprise an inner core of a first electrically conductive metal and an outer coating of lead laminated directly onto and covering the core.

26. The invention as defined in claim 22, wherein the anode assembly consists of two anode body segments only, including a central anode body segment and one generally U-shaped anode segment, the U-shaped segment having parallel outer side edges extending substantially perpendicular to the end edges of the respective segments.

27. The invention as defined in claim 26, wherein the anode body segments each comprise an inner core of a first electrically conductive metal and an outer coating of lead laminated directly onto and covering the core.

28. The invention as defined in claim 1, wherein the anode body comprises a central body segment and at least one generally U-shaped segment.

29. The invention as defined in claim 28, wherein the connector means further comprises tab means integrally formed on and projecting outwardly from one end edge of each of the body segments.

30. The invention as defined in claim 29, wherein the electrical connection means on the respective anode body segments are disposed in planes generally parallel to the plane of the anode body and spaced from one another to permit each anode segment to be electrically connected to a separate bus-bar extending transversely of the anode plate.

31. The invention as defined in claim 30, wherein the anode body segments each comprise an inner core of a first electrically conductive metal and an outer coating of lead laminated directly onto and covering the core.

32. The invention as defined in claim 1, wherein the mounting means for supporting the anode structure in the electroplating apparatus comprises means for supporting the anode in a vertical direction with the electrical connection means extending upwardly from the flat body.

33. The invention as defined in claim 32, wherein the electrical connection means on the respective anode body segments are disposed in planes generally parallel to the plane of the anode body and spaced from one another to permit each anode segment to be electrically connected to a separate bus-bar extending transversely of the anode plate.

34. The invention as defined in claim 33, wherein the anode assembly consists of two anode body segments only, including a central anode body segment and one generally U-shaped anode segment, the U-shaped segment having parallel outer side edges extending substantially perpendicular to the end edges of the respective segments.

35. The invention as defined in claim 34, wherein the anode body segments each comprise an inner core of a first electrically conductive metal and an outer coating of lead laminated directly onto and covering the core.

36. The invention as defined in claim 32, wherein the anode body segments each comprise an inner core of a first electrically conductive metal and an outer coating of lead laminated directly onto and covering the core.

37. The invention as defined in claim 1, wherein the anode body segments each comprise an inner core of a first electrically conductive metal and an outer coating of lead laminated directly onto and covering the core.

* * * * *

UNITED STATES PATENT AND TRADEMARK OFFICE

CERTIFICATE OF CORRECTION

PATENT NO. : 4,119,515

DATED : October 10, 1978

INVENTOR(S) : Andrew L. Costakis

It is certified that error appears in the above-identified patent and that said Letters Patent are hereby corrected as shown below:

Column 3, line 37, after "A" insert -- first --;
Line 49, "42" should be -- 40 --;
Line 50, "42" should be -- 32 --.
Column 4, line 67, "104" (second occurrence) should be -- 100 --.
Column 5, line 2, "102" should be -- 100 --.
Column 7, lines 33 and 34, "electrolite" should be -- electrolyte --.

Signed and Sealed this

*Twenty-ninth* Day of *May 1979*

[SEAL]

*Attest:*

RUTH C. MASON
*Attesting Officer*

DONALD W. BANNER
*Commissioner of Patents and Trademarks*